United States Patent [19]

Hamel

[11] Patent Number: 4,809,632

[45] Date of Patent: Mar. 7, 1989

[54] BOTTOM SCOOP FOR ENGINE COOLING WATER

[76] Inventor: Jay P. Hamel, 807 44th Ave., East, Ellenton, Fla. 34222

[21] Appl. No.: 134,053

[22] Filed: Dec. 17, 1987

[51] Int. Cl.[4] ..... B63B 13/00

[52] U.S. Cl. ..... 114/198; 440/88

[58] Field of Search ..... 114/185, 197, 198; 440/46, 88, 89, 112, 113

[56] References Cited

U.S. PATENT DOCUMENTS

| | | | |
|---|---|---|---|
| 2,462,450 | 2/1949 | Wilson | 440/88 |
| 2,466,525 | 4/1949 | Wilson | 440/88 |
| 3,874,317 | 4/1975 | Hikita | 440/88 |
| 3,878,807 | 4/1975 | Reskusic | 114/198 |

*Primary Examiner*—Joseph F. Peters, Jr.
*Assistant Examiner*—Jesus D. Sotelo
*Attorney, Agent, or Firm*—Gifford, Groh, Sheridan, Sprinkle and Dolgorukov

[57] ABSTRACT

A bottom scoop for collecting and admitting water to the propulsive power plant of a water craft includes an outer body portion secured to the outside surface of the hull of such water craft and an inner body portion removably disposed in said outer body portion. The inner body portion has openings in one end that admit water into a cavity in the inner body from which the water flows through a conduit through the hull that carries the water to the conventional cooling system of the power plant.

10 Claims, 1 Drawing Sheet

BOTTOM SCOOP FOR ENGINE COOLING WATER

BACKGROUND OF THE INVENTION

The present invention, in its broad aspect, relates to water craft propelled by a power plant such as a motor or engine and a propeller, and, more particularly, to bottom scoop devices for admitting cooling water into the power plant cooling system.

Motor boats and larger water craft propelled by a motor or engine connected to a propeller shaft require cooling water for cooling the cylinders of the motor or engine. The customary bottom scoop for receiving and admitting cooling water to the engine or motor cooling system is a unitary device fixed to the outside bottom surface of the hull. Such devices, from time to time, become clogged with debris, seaweed and other material so that it is necessary in some cases to haul the vessel out of the water, remove the scoop and clean and paint it before it is replaced on the hull. It is very difficult, in most instances, to apply paint to the inside surfaces of the conventional bottom scoop where paint is needed most.

But, those skilled in the art will recognize from the following description and the drawing of a preferred embodiment of my invention several features and advantages of a two-piece bottom scoop for engine cooling water.

PRIOR ART

In the prior art, the following patents represent the state of the art at the present time:

U.S. Pat. No. 2,462,450 and U.S. Pat. No. 2,466,525, both to J. H. Wilson disclose scoops and siphons that are unitary structures fixed to the outside bottom surface of a hull by means of which water, in which the water craft floats, is admitted to the cooling system for the motor or engine that connects to a propeller shaft to drive the water craft through the water.

SUMMARY OF THE INVENTION

In combination with a hull of a water craft, a scoop for collecting and admitting water to a propulsive power plant in the hull comprises a main outer body portion secured to the outside of said hull; said body portion having a conduit extending through the hull to carry water thereinto, and an inner body portion removably carried within said main body portion and having means for admitting water into said inner body portion and said conduit, together with means for maintaining said inner body portion within said outer body portion.

For a further understanding of the invention and for features and advantages thereof, reference may be had to the following description and to the drawing of a preferred embodiment of the invention.

DETAILED DESCRIPTION

Figure 1:
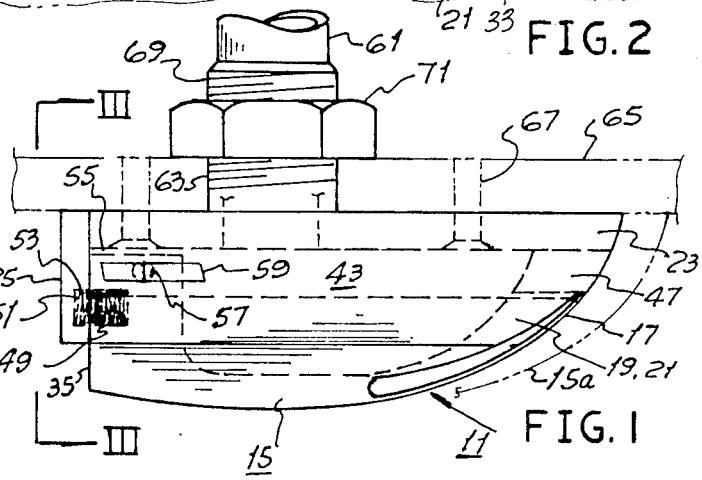
FIG. 1 is a schematic side elevational view of a bottom cooling water scoop and strainer in accordance with one embodiment of the present invention.

Referring to FIG. 1, a two-piece bottom cooling water scoop and strainer 11 in accordance with a preferred embodiment of my invention comprises a main outer body portion 13, and a removable inner body portion 15. The main outer body portion 13 is shaped generally as a parallelopiped having two long opposite sides 19,21; one end, the left-hand end as viewed in FIG. 1 that is square cut, and an opposite or right-hand end, as viewed in FIG. 1, that is arcuate and shaped about as shown. A top 23 is secured to the two sides 19,21 and an end piece 25 is secured to the left-hand end and to the sides 19,21. Each elongate side member 19 and 21 has an elongate rectangular-shaped groove 27 and 29, respectively, forming a shelf 31 and 33 on each side 19 and 21.

Figure 5:
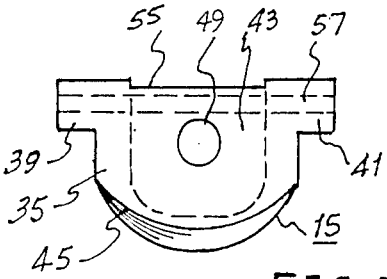
FIG. 5 is a view along line V—V of FIG. 3.
Figure 4:
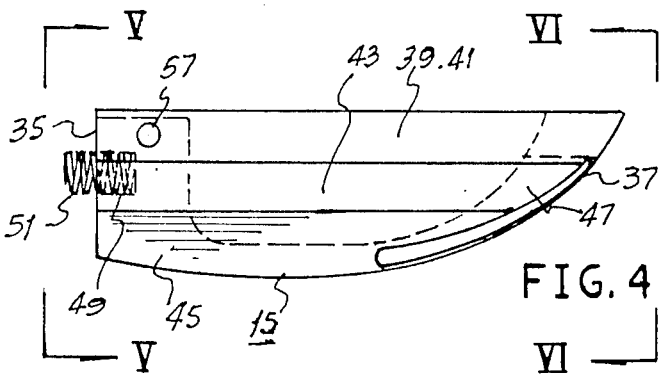
FIG. 4 is an elevational view of the inner member of the scoop and strainer of FIG. 1.
Figure 6:
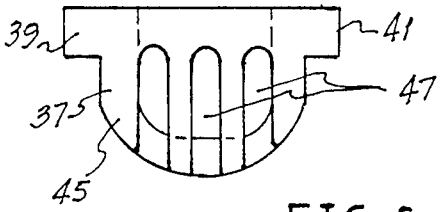
FIG. 6 is a view along line VI—VI of FIG. 3.

The removable inner body portion 15 is generally a streamlined parallelopiped, but has a flat one end 35, and left-handed end as shown in FIGS. 4 and 5, and an arcuate other end 37, the right-hand end, as viewed in FIGS. 4 and 6.

The inner body portion 15 has elongate shoulders 39,41 that extend the full length of the inner body portion 15 and that coact with the grooves 27,29 of the main outer body portion 13. The inner body portion is hollowed out to form a cavity 43, and the bottom 45 of the inner body portion 15 is arcuate, as viewed in FIG. 5.

The arcuate other end 37 of the inner body portion 15 has a plurality of slots 47 that provide access for water into the cavity 43. The flat one end 35 has a bore 49 therein that receives one end of a resilient member, such as a compression spring 51, that also is received in a bore 53 in the end piece 25 of the outer body portion 13.

The top surface of the flat one end 35 has a shallow depression 55 therein. Before the inner body portion 15 is installed in the outer body portion 13, the interior surfaces of the main outer body portion 13 are painted with a marine anti-fouling paint, or the like. In order not to scrape away any of this interior paint when the inner body portion 15 is installed in the outer body portion 13, there is the depression 55 in the inner body portion 15 that prevents scraping the interior paint from the outer body portion 13.

Figure 2:
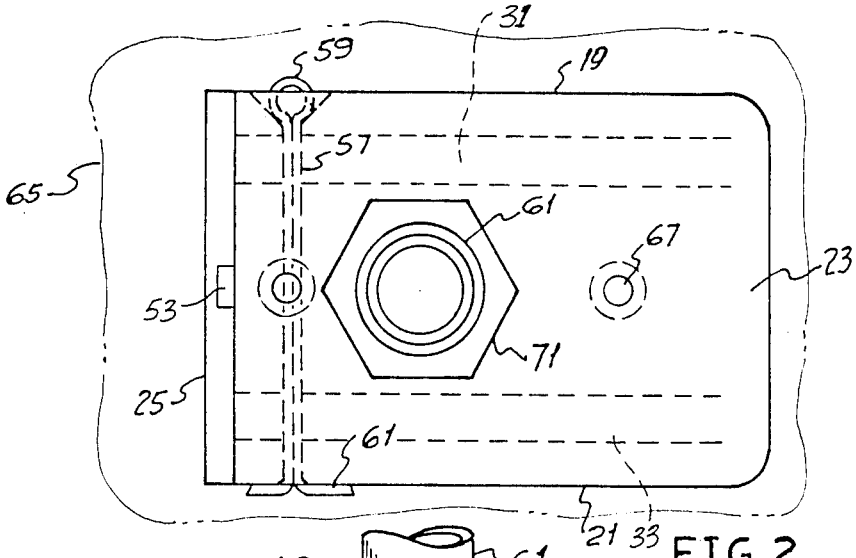
FIG. 2 is a plan view of the scoop and strainer shown in FIG. 1.
Figure 3:
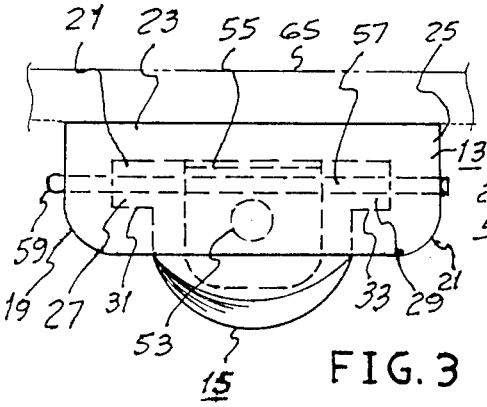
FIG. 3 is a view along line III—III of FIG. 1.

A bore 57 extends through the shoulders 39,41 of the inner body portion 15 and through the sides 19,21 of the main outer body portion 13. The through bore 57, in the side 19, is V-shaped on the outside to receive the eye end of a cotter pin 59 that passes through the bore 57. Then, when the split end 61 of the cotter pin is spread, as shown in FIG. 2, the inner body portion 15 is maintained in position within the main outer portion 13. The spring 51, being compressed, provides impetus to eject the inner body portion 15 from the outer main body portion when the cotter pin 59 is removed.

The main outer body portion 13 is provided with a tubular conduit 61 that communicates fluidly with the cavity 43 and that extends through an aperture 63 in the hull 65 of a vessel to which the bottom scoop 11 is secured by means of suitable fasteners 67.

The tubular conduit is threaded partially as at 69, and a nut 71 is threaded thereon to further secure the bottom scoop 11 to the hull 65.

In use, the main outer body portion 13 is attached to the bottom surface of a hull by means of the fasteners 67; the conduit 61 protruding through the hull 65 and the nut 71 being tightened to secure the outer body portion 13 in place. The engine cooling system is connected to the conduit 61 in a conventional manner and thereby receives cooling water.

The inner body portion 15 is inserted into the outer main body portion 13 so that the shoulders 39,41 ride in the grooves 27,29. The inner body portion 15 is pushed back, compressing the spring 51, until the aperture or bore 57 in both body portions is aligned to admit the cotter pin 59 through the outer and inner body portions. The cotter pin end 61 is then spread open and the ends bent over as shown to secure the inner body portion within the outer body portion.

When it is desirable to clean and repaint, after initial painting, the inner surfaces of the main outer body portion, the cotter pin is removed and, under the impetus of the spring, the inner body portion 15 moves toward the right to a position 15*a* shown in phantom, as viewed in FIG. 1. Cleaning and painting the interior of the body portions may then proceed.

From the foregoing description of a preferred embodiment of the present invention, those skilled in the art will recognize many features and advantages thereof, among which the following are significant:

That the scoop or strainer is easy to clean and paint; and

That the scoop or strainer of the present invention is simple to construct, is efficient and is a practical solution to a problem in the marine industry.

Although the invention has been described herein with a certain degree of particularity, it is understood that other modifications may be made therein without departing from the scope of the present invention as defined by the following claims.

What is claimed is:

1. In combination with a water craft having a hull, a scoop for collecting and admitting water into said hull for cooling a propulsive power plant in said water craft, comprising a main outer body secured to the outer surface of said hull; a conduit on said main outer body extending through said hull and carrying water thereinto; an inner body removably carried within said main outer body, and having means for admitting cooling water into said inner body.

2. The scoop of claim 1 wherein said admitting means on said inner body comprise openings in one end through which water enters said inner body.

3. The scoop of claim 1 including means for securing said main outer body to said hull.

4. The scoop of claim 1 including means within said hull for securing said scoop in place against said hull.

5. In combination with a water craft having a hull, a scoop for collecting and admitting water into said hull for cooling a propulsive power plant in said water craft, comprising:

a main outer body secured to the outer surface of said hull;

a conduit on said outer body portion extending through said hull and carrying water thereinto;

an inner body removably carried within said main outer body;

means for admitting cooling water into said inner body;

means for securing said inner body within said outer body;

and means coacting with said inner and outer bodies and urging said inner body out of said outer body.

6. The scoop of claim 5 wherein said securing means includes a removable pin extending through both said inner and outer bodies.

7. The scoop of claim 5 wherein said coacting means is a spring.

8. The combination of a water craft having a hull and a scoop for collecting and admitting water into said hull for cooling a propulsive power plant in said water craft comprising a main outer body portion on the outer surface of said hull and a conduit on said body portion extending through said hull adapted for carrying water thereinto; means for securing said main outer body to said hull; a removable inner body portion disposed within said outer body portion; means on said inner body for admitting water thereinto and thence into said conduit; means for securing said inner body within said outer body; and resilient means engaging both said inner body portion and said outer body portion urging said inner body portion out of said outer body portion.

9. The scoop of claim 8 wherein said means securing said inner body portion within said outer body portion includes a pin engaging both body portions.

10. The scoop of claim 8 wherein said resilient means includes a spring coacting with both said body portions.

* * * * *